US005811767A

United States Patent [19]

Wildi

[11] Patent Number: 5,811,767

[45] Date of Patent: Sep. 22, 1998

[54] THREE WIRE, THREE-PHASE HEATING CABLE AND SYSTEM

[75] Inventor: Theodore Wildi, Quebec, Canada

[73] Assignee: Sperika Enterprises Ltd., Quebec, Canada

[21] Appl. No.: 767,326

[22] Filed: Dec. 16, 1996

[51] Int. Cl.[6] ..... H05B 3/02

[52] U.S. Cl. ..... 219/539; 219/213; 219/544

[58] Field of Search ..... 219/212, 528–539, 219/544, 548, 213; 174/68.2

[56] References Cited

U.S. PATENT DOCUMENTS

| | | |
|---|---|---|
| 2,042,742 | 6/1936 | Taylor . |
| 2,287,502 | 6/1942 | Togesen et al. . |
| 3,213,300 | 10/1965 | Davis . |
| 3,364,335 | 1/1968 | Palatini et al. . |
| 4,908,497 | 3/1990 | Hjortsberg . |
| 4,998,006 | 3/1991 | Perlman . |
| 5,081,341 | 1/1992 | Rowe . |
| 5,218,185 | 6/1993 | Gross . |
| 5,410,127 | 4/1995 | LaRue et al. . |

OTHER PUBLICATIONS

"Reduction of Power System Magnetic Field by Configuration Twist", 1997 IEEE, PE–141–PWRD–0–Dec. 1996, Per Pettersson and Niclas Schönborg.

"Predicting the Magnetic Fields from a Twisted–Pair Cable", J.R. Moser et al, IEEE Transactions on Electromagnetic Compatibility, vol. EMC–10, No. 3, Sep. 1968, pp. 324–330.

"The Magnetic Field in the vicinity of Parallel and Twisted . . . Three–Phased Current", F. Haber, IEEE Transactions on Electromagnetic Compatibility, vol. EMC–16, No. 2, May 1974, pp. 76–82.

"Magnetic Fields of Twisted–Wire–Pairs", S. Shenfeld, IEEE Transactions on Electromagnetic Compatibility, vol. EMC–11, No. 4, Nov. 1969, pp. 164–169.

Documentation of the Threshold Limit Values, "For Physical Agents in the Work Environment", ACGIH, pp. PA–iii, PA–1 and PA–55 to PA–64.

*Primary Examiner*—Tu B. Hoang

*Attorney, Agent, or Firm*—Swabey Ogilvy Renault; Guy J. Houle

[57] ABSTRACT

An electrical three-phase heating cable and system that produces a reduced magnetic field and which uses a cable containing three insulated copper wires, or equivalents, as heating elements. The wires are equidistantly spaced from each other, in triangular configuration, the geometric center of the triangle coinciding with the longitudinal axis of the cable. The wires are twisted in a uniform fashion along the longitudinal axis of the cable. Its low operating temperature, robustness and safety enable the system to be installed, for example, in floors and walls for the general heating of buildings, and in outdoor pavements, for snow-melting purposes, etc. The feeder conductors are also twisted to reduce the magnetic field around the feeder.

30 Claims, 10 Drawing Sheets

$I_A = I_m$
$I_B = -0.5I_m$
$I_C = -0.5I_m$ $I_A = 0.866\,I_m$
$I_B = 0$
$I_C = -0.866\,I_m$ $I_A = 0.5\,I_m$
$I_B = 0.5\,I_m$
$I_C = -I_m$ $I_A = 0$
$I_B = 0.866\,I_m$
$I_C = -0.866\,I_m$

THREE WIRE, THREE-PHASE HEATING CABLE AND SYSTEM

TECHNICAL FIELD

This invention relates to an electrical heating system wherein the magnetic field is reduced around the heating cables and the associated feeder, and wherein each cable contains three equidistant wires that are twisted to create a uniform spiral around the longitudinal axis of the cable so as to diminish the magnetic field surrounding the cable, and further wherein the wires of the heating cables are connected to a 3-phase voltage supply source.

BACKGROUND ART

Extra-low-voltage systems for heating concrete floors have been used in the past by circulating an electric current in the reinforcing steel wire mesh within a concrete slab. In these 60 Hz systems, the voltage is typically limited to a maximum of 30 volts. These extra-low-voltage systems offer many advantages, but they also have some shortcomings as follows:

1. On account of the low voltage and relatively high power, large currents are required, which generate a strong magnetic field around the busbars and wire meshes.
2. The magnetic field interferes with the image on some computer and television screens, causing it to jitter. It has been found that in order to reduce the jitter to an acceptable level, the peak flux density must be less than 5 microteslas (5 $\mu$T), which corresponds to 50 milligauss (50 mG). In some extra-low-voltage heating systems of the prior art, the flux density can exceed 100 $\mu$T (1000 mG) at a distance of 5 feet above the floor.
3. The magnetic field is perceived by some people to be a potential health hazard. Opinions vary as to the acceptable exposure limits to 50 Hz and 60 Hz magnetic fields. In a publication by the American Conference of Governmental Industrial Hygienists entitled *Sub-Radio Frequency* (30 *kHz and below*) *Magnetic Fields*, continuous exposure limits of 100 $\mu$T (1000 mG) are suggested for members of the general public.

It should be noted that the ambient 60 Hz flux density in a home is typically 1 mG to 2 mG, while that along a busy street ranges from 0.5 mG to 5 mG. The flux density near a coffee machine equipped with an electric clock varies from 10 mG to over 100 mG, depending upon the distance from the machine.

The SI unit of magnetic flux density is the tesla. One microtesla (1 $\mu$T) is equal to 10 milligauss (10 mG).

The concern with possible biological effects has given rise to several methods of reducing the magnetic fields of electric heating systems. In this regard, we make reference to the following patents:

U.S. Pat. No. 5,410,127 to John D. Larue issued on Apr. 25, 1995, describes the wire layout in an electric blanket wherein a twisted pair resistive element is used to reduce the magnetic field. U.S. Pat. No. 5,218,185 to Thomas A. O. Gross, issued on Jun. 8, 1992, illustrates a twisted pair bifilar heater cable to reduce the magnetic field around a heating pad. U.S. Pat. No. 5,081,341 to William M. Rowe, issued Jan. 14, 1992, describes how a magnetic field can be reduced by arranging helically-wound wires in a coaxial manner so that currents flow in essentially opposite directions. U.S. Pat. No. 4,998,006 to Daniel Perlman issued on Mar. 5, 1991, there is described how a magnetic field can be reduced by arranging wires in parallel and in helical fashion so that currents flow in essentially opposite directions. U.S. Pat. No. 4,908,497 to Bengt Hjortsberg, issued Mar. 13, 1990, describes how a magnetic field can be reduced by arranging successive rows of four wires in series so that currents flow in essentially opposite directions. These patents are mainly concerned with low-power devices such as comfort heaters and water beds that are in particularly close contact with the human body.

U.S. Pat. No. 3,364,335 to B. Palatini et al, issued on Jan. 16, 1968 describes a relatively high voltage three-phase heating system to reduce the size of the conductors. The objective is to eliminate the danger of high voltages by using a differential protection. There is no mention of magnetic fields. U.S. Pat. No. 2,042,742 to J. H. Taylor, issued on Jun. 2, 1936 discloses the use of a 3-conductor insulated heating cable mounted on a panel, but no 3-phase source. The low temperature system uses copper wire as heating element. The Patent also states that circuits of considerable length can be made this way. There is no mention of magnetic fields. U.S. Pat. No. 3,213,300 to R. S. Davis, issued on Oct. 19, 1965, describes the use of a low reactance cable. Finally, U.S. Pat. No. 2,287,502 to A. A. Togesen, issued on Jun. 23, 1942 describes "closely spaced busbars within the pairs, effects a reduction in the magnetic field."

From the above, it is known in the art of constructing heating blankets or appliances that twisting a two-wire conductor carrying a dc current or a single-phase ac current results in a reduction of the flux density around a conductor.

In my co-pending U.S. patent application Ser. No. 08 659 180, filed on Jun. 6, 1996 and entitled "LOW-VOLTAGE AND LOW FLUX DENSITY EATING SYSTEM", there is described a low-voltage heating system wherein the magnetic field is reduced, both around the heating cables and the feeder that supplies power to the cables. Each cable contains six wires that are configured and interconnected in a specific way so as to minimize the magnetic field surrounding the cable. A three-phase, five-conductor feeder is also described whereby the magnetic field surrounding the feeder is reduced.

In my other co-pending U.S. patent application No. 08/670,413 filed on Jun. 26, 1996 and entitled "EXTRA-LOW-VOLTAGE HEATING SYSTEM", there is described a low-voltage heating system wherein the magnetic field is reduced, both around the heating cables and the feeder that supplies power to the cables. Each cable contains three wires that are configured in a co-planar relationship and interconnected in a specific way so as to minimize the magnetic field surrounding the cable. A single-phase three-conductor feeder is also described whereby the magnetic field surrounding the feeder is reduced.

It is well known that an ac current flowing in a long, straight wire produces an alternating magnetic field in the space around the wire. The magnetic field is constantly increasing, decreasing and reversing. In a 60 Hz system, the flux density reaches its maximum value 120 times per second. The flux density is given by the well-known physical equation:

$$B = \frac{2I}{D} \tag{1}$$

in which

B=instantaneous flux density at the point of interest, in milligauss [mG]

I=instantaneous current flowing in the wire, in amperes [A]

D=shortest distance between the center of the wire and the point of interest, in meters [m].

Among its other features, the invention disclosed herein describes a three-phase twisted heating cable that produces a particularly low magnetic field and low magnetic flux density.

In commercial and industrial 3-phase installations, the three currents $I_A$, $I_B$, $I_C$ flowing in a 3-wire cable vary sinusoidally according to the equations:

$$I_A = I_m \cos \omega t \quad (2)$$

$$I_B = I_m \cos (\omega t - 120) \quad (3)$$

$$I_C = I_m \cos (\omega t - 240) \quad (4)$$

In these equations, $I_m$ is the peak current, ω is the angular frequency in degrees per second, t is the time in seconds, and ωt is the time expressed in electrical degrees. Table 1 shows the resulting instantaneous currents flowing in the three wires at various instants of time, during one cycle. An angle ωt of 360 degrees corresponds to 1/f seconds, where f is the frequency of the power source.

TABLE 1

| ωt | $I_A$ | $I_B$ | $I_C$ |
|---|---|---|---|
| 0 | $I_m$ | −0.5 $I_m$ | 0.5 $I_m$ |
| 30 | 0.866 $I_m$ | 0 | −0.866 $I_m$ |
| 60 | 0.5 $I_m$ | 0.5 $I_m$ | −$I_m$ |
| 90 | 0 | 0.866 $I_m$ | −0.866 $I_m$ |
| 120 | −0.5 $I_m$ | $I_m$ | 0.5 $I_m$ |
| 150 | −0.866 $I_m$ | 0.866 $I_m$ | 0 |
| 180 | −$I_m$ | 0.5 $I_m$ | 0.5 $I_m$ |
| 210 | −0.866 $I_m$ | 0 | 0.866 $I_m$ |
| 240 | −0.5 $I_m$ | −0.5 $I_m$ | $I_m$ |
| 270 | 0 | −0.866 $I_m$ | 0.866 $I_m$ |
| 300 | 0.5 $I_m$ | −$I_m$ | 0.5 $I_m$ |
| 330 | 0.866 $I_m$ | −0.866 $I_m$ | 0 |
| 360 | $I_m$ | −0.5 $I_m$ | −0.5 $I_m$ |

The instantaneous magnetic field surrounding a cable depends upon the configuration of the wires and the instantaneous currents they carry.

Because the currents are alternating, they change in value and direction from one instant to the next. It is therefore necessary to determine when the flux density is maximum and what its value is at that particular moment. In the present disclosure, we first examine the flux density surrounding a 3-wire, 3-phase cable in which the wires are not twisted. Subsequently, we investigate a cable having three wires that are twisted around the longitudinal axis of the cable. The flux density formulas for the untwisted and twisted configurations are then revealed and compared.

SUMMARY OF THE INVENTION

This invention concerns a 3-phase electrical heating system having twisted heating cables for space heating and snow-melting applications. It comprises a plurality of three-wire heating cables that are powered by a low-voltage or an extra-low-voltage three-phase voltage source. The heating system is principally, although not exclusively, intended for heating a flat surface and among its several applications, the system is designed for direct burial in a concrete floor, with the cables lying about 50 mm below the surface. The cables are designed to produce a specified amount of thermal power per unit length, $P_C$ (watts per meter). The maximum value of $P_C$ depends upon the maximum allowable temperature of the cable. The temperature is typically limited to a maximum of 90° C. Consequently, the heating system can be considered to be a low-temperature system.

Individual cables may comprise one or more cable runs. If there is more than one cable run per cable, the cable runs are contiguous and generally laid out in sinuous fashion. The cable runs covering a given heated surface are laid out side by side. The distance between runs is determined by $P_C$ and the desired thermal power density $P_D$ (watts per square meter). The invention seeks to reduce the magnetic flux density around the cables, and hence around the heated surface. The invention also includes a three-phase, twisted feeder that produces a reduced magnetic field.

Each heating cable comprises three identical equidistantly-spaced insulated wires that are smoothly twisted in spiral fashion along the longitudinal axis of the cable. The wires are in close proximity to each other. The pitch of the spirals is relatively short so as to reduce the magnetic field around the cable to an acceptable level, particularly at distances exceeding 50 mm from the cable. The three wires at one end of the respective cables are short-circuited and those at the other end are connected to a three-phase feeder. Consequently, the cables are connected in star, a term well known in three-phase circuits.

The said wires are made of a low resistivity material, such as copper or aluminum, in order to obtain substantial cable lengths.

The present disclosure includes special formulas that have been derived to permit the approximate calculation of the magnetic flux densities surrounding the cables.

The following features are derived from the present invention:

1) Safety. The extra-low-voltage application of the heating system ensures safety from electric shock;

2) Robustness. The cable contains three wires and hence is able to withstand considerable mechanical abuse while it is being installed;

3) Insulation. The cable and its wires are insulated and protected by an insulating sheath; consequently, the cables can come in direct contact with surrounding metal parts;

4) Balanced 3-phase system. The individual heating cables constitute an inherently balanced three-phase load which meets electric power utility requirements.

5) Low temperature. The heating system operates at low temperatures which ensures long life and reduces the fire hazard.

According to a further broad aspect of the present invention, there is provided an electrical heating system for heating a surface area. The system comprises at least one cable having three conductive heating wires contained in an insulated sheath. The wires are permanently fixed in a specific physical configuration from one another. They are connected together at a far end of the cable, and a three-phase voltage supply source is connected to the wires at the near end of the cable. The wires have a low resistivity, similar to that of copper or aluminum. The length ($L_A$) of the cable depends upon the specific parameters of the heating system, including (i) the operating voltage (E) of the supply source, (ii) the total cross sectional area (A) of the three heating wires, (iii) the resistivity (ρ) of the wire material, (iv) the desired power per unit length ($P_C$) of the cable, (v) the distance (d) as measured between a center of said wires and (vi) a pitch (L) of said cable. The three wires are symmetrically arranged in a triangular configuration such that they are located at a distance (r) from a longitudinal axis of the cable, as measured from a center of said wires. The cable is twisted with a pitch (L) as measured along the said longitudinal axis of the cable. The cable produces a resultant magnetic flux density ($B_T$) having a substantially specific value calculated at a predetermined distance from the cable, according to the following formula $$B_T = 108 \frac{I_L d}{L^2} \left(\frac{D}{L}\right)^{-5.755-2.541\ log_{10}(D/L)}$$

said formula constituting the result of an ordinary least squares regression of points derived from calculated values of log ($B_T L^2/I_L$ d) versus log (D/L), and within the limits D>5 d and 0.1 L<D<1.2 L, and wherein the symbols carry the following units: d, D, and L in millimeters, $I_L$ in amperes RMS and $B_T$ in milligauss RMS. L is the pitch of the cable, d is the distance between the centers of the wires, $I_L$ is the RMS line current carried by each of the three wires, and D is the perpendicular distance from the longitudinal axis of the cable.

BRIEF DESCRIPTION OF DRAWINGS

A preferred embodiment of the present invention will now be described with reference to the accompanying drawings, which show various examples of the invention, including its several advantages.

FLUX DENSITY PRODUCED BY A 3-PHASE STRAIGHT STAR CABLE

Figure 1:
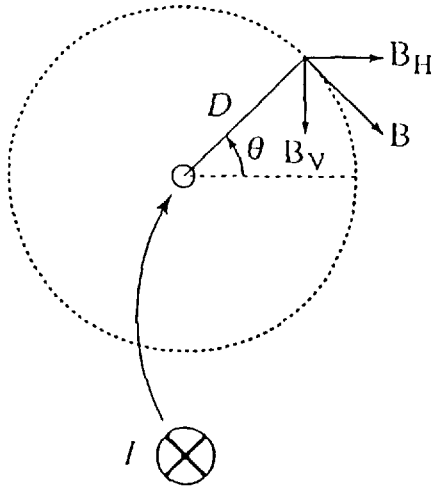
FIG. 1 is a schematic diagram showing the cross section of a single wire carrying a current, and the resulting magnetic flux density it produces, together with the horizontal and vertical components.

Referring to FIG. 1, there is shown the cross section of a straight wire carrying an alternating current having an instantaneous value I, flowing in a "positive" direction. The "cross" of the conventional dot/cross notation indicates that the "positive" current is flowing into the page. As previously stated, the instantaneous value of the flux density is given by:

$$B = \frac{2I}{D} \qquad \text{Eq. 1}$$

It is well known that this flux density is directed at right angles to a ray having a radius D whose origin coincides with the center of the wire. It follows that the horizontal and vertical flux density components $B_H$ and $B_V$ at the end of a ray inclined at θ degrees to the horizontal axis, are respectively given by:

$$B_H = B \sin \theta \qquad (5)$$

$$B_V = B \cos \theta \qquad (6)$$

For the current direction shown (into the page), positive values of $B_H$ are directed to the right, while positive values of $B_V$ are directed downwards.

Figure 2A:
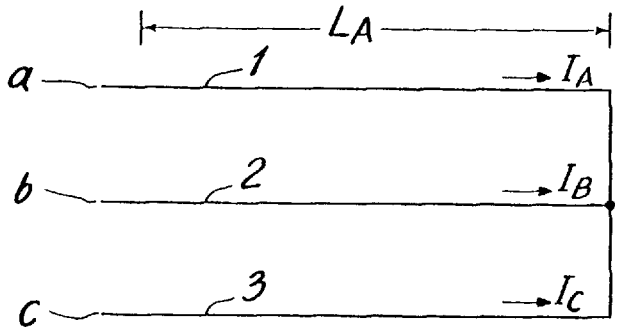
FIG. 2*a* is a schematic diagram representing either a straight star cable or a twisted star cable.

FIG. 2*a* is a schematic diagram of a cable having three wires 1, 2, 3, in close proximity to each other. The wires are straight, lying parallel to the longitudinal axis of the cable. (Alternatively, in another embodiment of FIG. 2*a,* they may be twisted around the said longitudinal axis). The cable has a length $L_A$. At a far end of the cable, opposite to the source, wires 1, 2, 3 are connected together at junction N while connecting leads a, b, c at a near end, are connected to a 3-phase source (not shown). The wires are therefore connected in star and because the wires are straight, we call this a straight star cable, for purposes of ready identification.

Figure 2C:
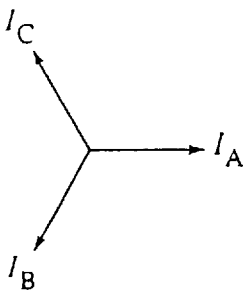
FIG. 2*c* is a phasor diagram of the three-phase currents flowing in the wires of a star cable.
Figure 2B:
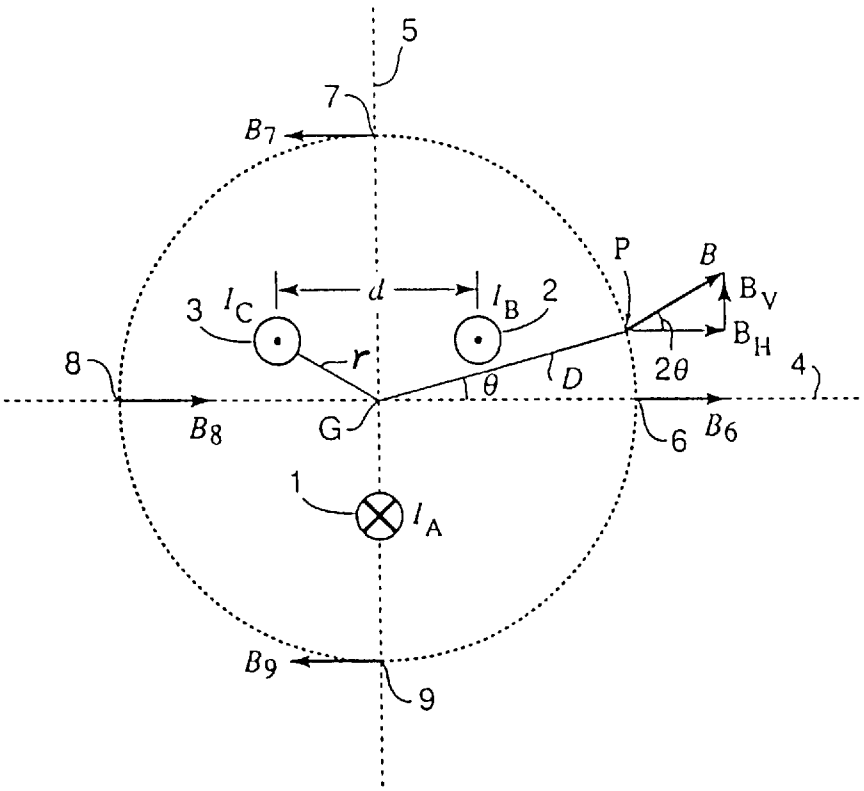
FIG. 2*b* is a schematic cross section view of a straight star cable, when connected to a three-phase source, showing the resulting flux density components around the cable, at a moment when the current in one wire is maximum.

FIG. 2*b* is a cross section view of a 3-wire cable in which the wires are straight, i.e. not twisted. The wires are symmetrically located at the corners of an equilateral triangle whose geometric center G lies on the longitudinal axis of the cable. The centers of the wires are spaced at a distance d from each other and are located at a distance r from the geometric center G. The three wires are enclosed in a protective sheath (not shown).

The wires carry 3-phase alternating currents having instantaneous values $I_A$, $I_B$, $I_C$, that respectively flow in wires 1, 2, 3. Let us draw a line 4 that passes through G and that is parallel to a hypothetical horizontal line joining the centers of wires 2, 3. A vertical line 5, drawn through point G, passes therefore through the center of wire 1. Next, let us draw a circle centered at G that has an arbitrary radius D. The circle represents the set of arbitrary points where we wish to determine the flux densities created by the three-phase currents. The circle intersects lines 4 and 5 at points 6, 7,8,9.

It can be shown that if the radius D of the circle is greater than 5 d, the magnitude of the flux density at every point around the circle is substantially the same. Its approximate value is given by:

$$B_m = \frac{3\,I_m r}{D^2} \tag{7}$$

where $B_m$=peak flux density as measured by a single-axis flux density probe, [mG];

$I_m$=peak line current of the 3-phase cable, [A];

r=radial distance between the centers of the wires and the geometric center G, [m];

D=radial distance from G to the circumference of the circle, [m];

In this equation, the magnitude of $B_m$ is independent of the instantaneous values of the currents $I_A$, $I_B$, $I_C$ flowing in the wires, provided the said instantaneous values vary according to equations (2), (3), (4).

For illustrative purposes, in FIG. 2*b,* we have selected an instant when $I_A$=+$I_m$, while $I_B$ and $I_C$ are respectively equal to −0.5 $I_m$. It follows that $I_A$ is maximum and flowing into the page, while $I_B$ and $I_C$ are flowing out of the page (towards the reader). The corresponding phasor diagram is shown in FIG. 2*c.*

Given these instantaneous currents $I_A$, $I_B$, $I_C$, the flux density $B_6$ at point 6 is directed to the right along horizontal line 4. At diametrically opposite point 8, the flux density $B_8$ is also directed to the right. However, at points 7 and 9, the flux densities $B_7$ and $B_9$ are directed to the left. Indeed, they orientation of the flux density changes continually as we move around the circle. Consider, for example, a ray such as GP that is oriented at θ degrees to a horizontal line 4. At the instant shown in FIG. 2*b,* it can be shown that the flux density B at point P is oriented at an angle 2θ to the horizontal.

Consequently, the horizontal and vertical components of this flux density at point P are found to be respectively:

$$B_H = B_m \cos 2\theta \tag{8}$$

$$B_V = B_m \sin 2\theta \tag{9}$$

Thus, at this particular moment, the magnitude of the flux density $B_m$ is the same everywhere around the circle, but its orientation depends upon its position on the circle, as depicted in the figure.

As we have seen in Table 1, the instantaneous alternating currents in the three wires are continually changing in magnitude and direction. Consequently, it is to be expected that the orientation of the flux density at a specific point on the circle will also be continually changing. To illustrate the change in orientation with time, we show the flux patterns surrounding the cable at four different instants (FIGS. 3*a,* 3*b,* 3*c* and 3*d*).

Figure 3A:
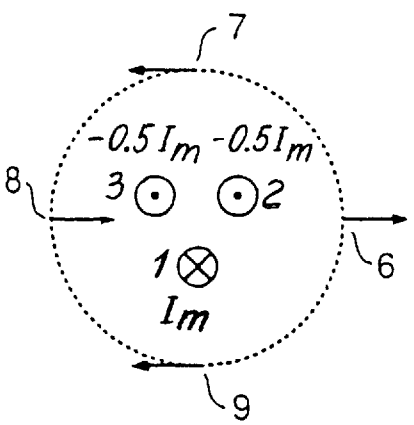
FIGS. 3*a,* 3*b,* 3*c,* 3*d* are schematic diagrams showing the currents flowing in a straight star cable, at successive instants of time, together with the corresponding flux density patterns surrounding the cable.

The currents in FIG. 3*a* are the same as those in FIG. 2*b* and so the flux pattern, such as at points 6, 7, 8, 9, is the same.

Figure 3B:
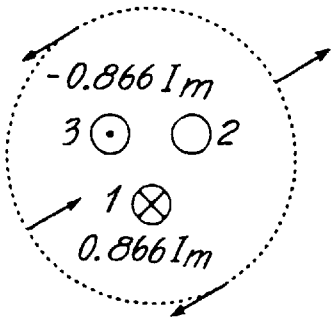
Figure 3B:
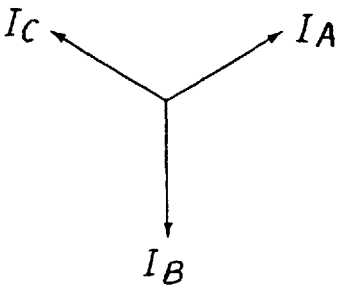

FIG. 3*b* shows the currents one twelfth of a cycle later, which corresponds to a phasor shift of 30°. Consequently, $I_A$=+0.866 $I_m$, $I_B$=0, and $I_C$=−0.866 $I_m$. This produces the flux pattern shown in FIG. 3*b.* The magnitude of the flux densities around the circle is the same as in FIG. 3*a,* but the global orientation of the flux pattern has shifted by 30°.

Figure 3C:
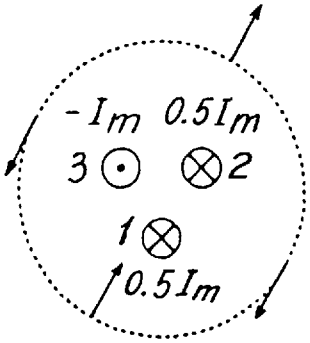
Figure 3C:
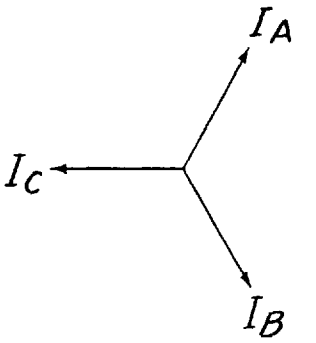
Figure 3D:
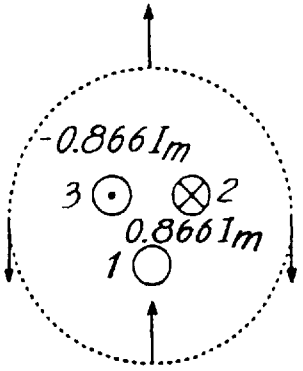
Figure 3D:
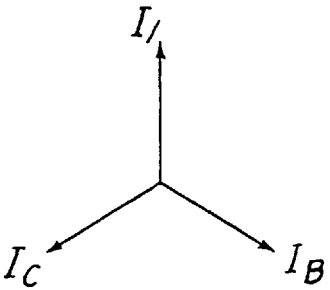

Another twelfth of a cycle later (FIG. 3*c*), the current phasors have shifted by an additional 30°, with the result that $I_A$=+0.5 $I_m$, $I_B$=+0.5 $I_m$, and $I_C$=−$I_m$. This causes the global flux density pattern to move by another 30° as shown in FIG. 3*c.* Then, when the phasors have moved through one quarter of a cycle, we obtain the flux pattern shown in FIG. 3*d.*

It is seen that the global flux pattern around the circle retains the same shape, but it effectively rotates around the cable at a speed given by n=60 f where n is in revolutions per minute and f is the frequency of the ac current. Thus, if the frequency is 60 Hz, the flux rotates at 3600 r/min around the cable.

Consider now a stationary point, such as point P in FIG. 2*b.* As the currents take up successive values, the flux density $B_m$ at point P retains the same value but changes its orientation from one instant to the next. In effect, it makes a complete turn during one cycle. As a result, when the cable is connected to a 60 Hz, 3-phase source, the flux density at point P is constant in value, but rotates around point P as center, at 3600 r/min. Under these conditions, a single-axis flux density probe will "see" a flux density that alternates and passes through zero. However, a three-axis probe will measure a flux density that never falls to zero but remains permanently at its peak value $B_m$. As a result, in a three-phase field created by a cable consisting of three straight wires arranged as shown in FIG. 2*b,* a three-axis probe will register a flux density that is √2 times larger than that of a single-axis probe.

According to Eq. (7), the magnitude of the flux density at a given point depends linearly upon the radial distance r which, in turn, depends upon the spacing d between adjacent wires. The relationship between d and r is given by $$d = r\sqrt{3}\ . \tag{10}$$

Combining Eqs. (7) and (10) and recognizing that $I_m$=√2 times the RMS value of the line current $I_L$, and that 1 meter=1000 mm, we can write:

$$B_T = \frac{2450\,I_L d}{D^2} \tag{11}$$

in which $B_T$=total RMS flux density as measured by a three-axis probe [mG]

$I_L$=RMS line current [A]

d=distance between the centers of the wires [mm]

D=distance from the longitudinal axis at the geometric center of the cable, to the point of measurement of the flux density [mm]

RMS stands for root mean square.

To minimize the flux density around the cable, the spacing d between the wires should be as small as is feasible. For a given cable, this spacing is obviously fixed.

As an example of the application of Eq. (11), if the cable carries a 3-phase RMS line current $I_L$ of, say, 45 A, and the distance d=5 mm, the total RMS flux density at a distance D of 75 mm from the longitudinal axis of the cable is $$B_T = \frac{2450\,I_L d}{D^2} = \frac{2450 \times 45 \times 5}{75^2} = 98\ \text{mG}$$

A flux density of 98 mG is what would be measured by a three-axis RMS magnetic flux density probe.

Eq. (11) reveals that the flux density around a straight star cable decreases inversely as the square of the distance D. Consequently, as we move away from the cable, the flux density decreases by 20 percent for each 10 percent increase in the value of D.

Special configurations using other straight-wire cables, can produce flux densities that diminish inversely as the cube of the distance. In this case, the flux density falls by 30 percent for every 10 percent increase in the distance from the cable. From a flux density standpoint, these configurations are more attractive but involve higher costs.

TWISTING THE CABLE

Suppose now that a cable containing three straight wires whose centers are equidistantly spaced at a distance d from each other, is uniformly twisted along its longitudinal axis so that the resulting pitch has a length L. By definition, for a given pitch L (arbitrarily selected anywhere along the length of the cable), the cross section of the cable at the beginning of the pitch will be oriented the same way as that at the end. In other words, the three wires carrying currents $I_A$, $I_B$, $I_C$, will be spatially oriented in exactly the same way at the beginning and end of length L. However, for intervals along the cable separated by distances of L/2, the position of the wires is rotated by 180°.

Figure 4B:
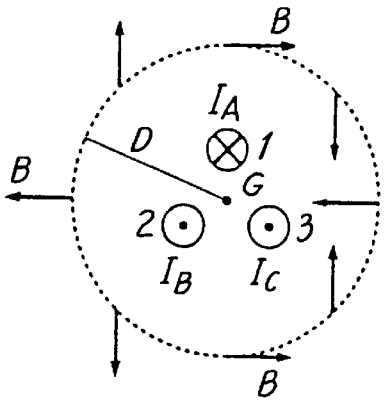
FIGS. 4*a,* 4*b* are cross section views showing the currents and flux densities at two different locations along a twisted star cable that are separated by a distance of one-half pitch.
Figure 4A:
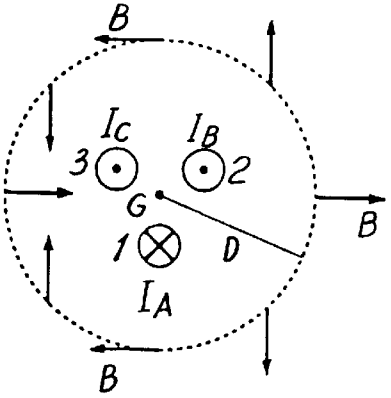

For example, suppose that the currents in the cable are momentarily $I_A=+I_m$, $I_B=-0.5\ I_m$, and $I_C=-0.5\ I_m$. A cross section view taken at a given point along the cable might then appear as shown in FIG. 4*a*. However, at a distance L/2 further along the cable, the cross section will be rotated by 180°, as shown in FIG. 4*b*. For equal radial distances D from the geometric centers G in FIGS. 4*a* and 4*b*, the orientation of the flux densities are opposite to each other, point by point around the respective circles. If the cross sections were superposed (rather than separated by a distance L/2), the flux densities would cancel each other, point by point around the circle, producing a net flux of zero.

It must be remembered that the flux densities are actually due to the magnetomotive forces of the currents flowing in the wires. These magnetomotive forces act not only in the immediate vicinity of a given cross section but spill over to to the regions at the right and left of it.

Consequently, a portion of the magnetomotive force developed by the cross section in FIG. 4*a* will act in opposition to the local magnetomotive force produced by the cross section in FIG. 4*b*, even though the latter is located L/2 meters away. Similarly, a portion of the magnetomotive force developed by the cross section in FIG. 4*b* will have a flux-reducing effect on the region surrounding the cross section in FIG. 4*a*. This holds true for all cross sections that are separated by distances L/2. Consequently, the flux density surrounding the twisted cable is everywhere less than if the wires in the cable were straight. Intuitively, one is led to the conclusion that the reduction in flux will be greater the shorter the pitch because oppositely-oriented cross sections are then closer to each other.

Figure 5A:
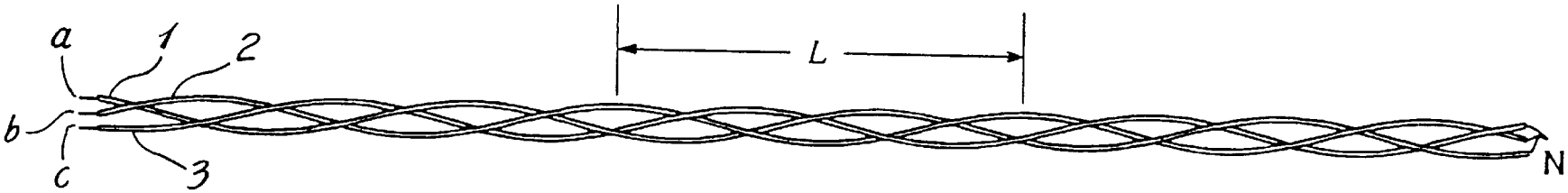
FIG. 5*a* is a schematic diagram of a twisted star cable showing the length L of one pitch, the configuration of the wires, the connecting leads at the near end, and the junction N at the far end of the cable.

FIG. 5*a* shows a three-phase, 3-wire, twisted cable wherein the wires are spaced equidistantly from each other and length L corresponds to one pitch. The schematic diagram of this cable can be represented by FIG. 2*a*.

Figure 5B:
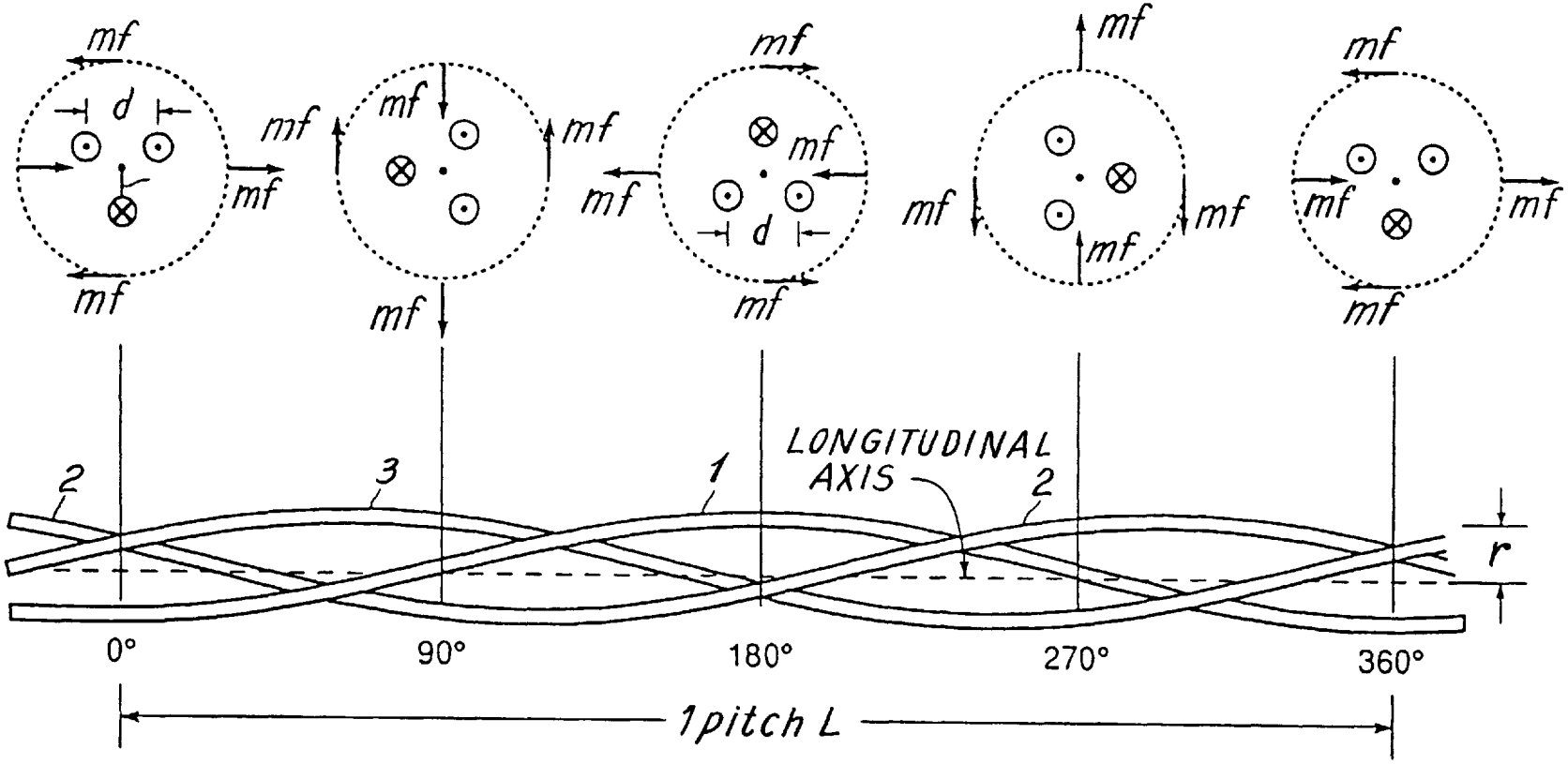
FIG. 5*b* is a schematic diagram of a three-phase twisted cable over a length of one pitch, showing the longitudinal axis, together with cross section views at five different locations along its length, showing the orientation of the local magnetomotive forces.

FIG. 5*b* shows in greater detail the configuration of the equidistant wires over the length of one pitch. The centers of the wires are everywhere located at a distance r from the longitudinal axis of the cable. One pitch corresponds to an axial rotation of the cable of 360°. The cross sections at twists of 0°, 90°, 180°, 270° and 360° show the direction of current flows in the wires 1, 2, 3, together with the resulting orientation of the local magnetomotive forces, i.e. the magnetic intensities, mf. It again illustrates that the magnetic intensities act in opposite directions for all cross sections that are separated by 180° rotational intervals.

Unfortunately, this intuitive understanding of how the flux density is reduced by twisting does not enable us to predict the value of the flux density at a given point from the center of the cable. Nor does it permit us to evaluate the rate at which the flux density will fall as a function of the increasing distance D.

To answer these questions, I proceeded with a detailed analysis of the flux densities produced by a three-phase twisted cable. It revealed a surprising and unexpected result. In effect, the flux density around the twisted cable decreases not inversely as the square of the distance D but by values ranging from the square to the sixth power of D. In space-heating systems, such a drastic reduction in the flux density with distance has important applications.

Figure 6:
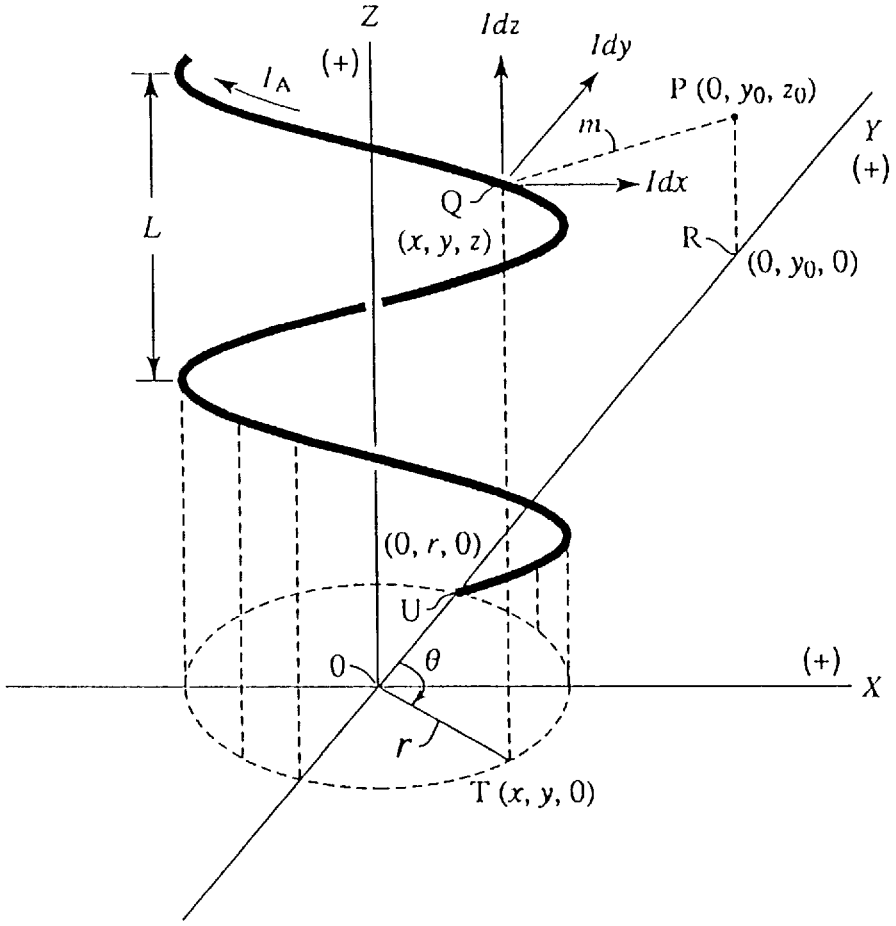
FIG. 6 is a three-dimensional view of one wire that spirals along a longitudinal axis of a twisted star cable, together with the X, Y, Z coordinates.

FIG. 6 shows a single spiraling wire of a three-phase twisted cable. The wire corresponds to phase A. The position of every point along the wire is made in reference to the coordinate axes X, Y, Z whose origin is O. The axes are mutually at 90° to each other and their positive directions are shown by (+) signs.

The wire has a pitch L and every segment along its length is located at a distance r from the longitudinal axis of the cable. This axis coincides with the coordinate axis OZ.

The wire passes through a point (0, r, 0) in the XY plane and continues to spiral upwards along the Z axis.

In order to establish the necessary equations, we consider an arbitrary point Q on the wire, having coordinates (x, y, z). This point corresponds to an angular rotation θ from the OY axis in the XY plane.

The position of point P, where the flux density is to be measured, is also specified. Its coordinates are (0, $y_0$, $z_0$). In accordance with our previous definition, $y_0$ corresponds to the distance D. The distance between points P and Q is designated by the symbol m.

The wire carries a sinusoidal current whose instantaneous value is $I_A$.

We first examine the flux density created by a short segment of wire that subtends an angle dθ in the XY plane. The short segment can be decomposed into three mutually orthogonal segments dx, dy, dz. Applying the Biot-Savart law, these segments give rise to elementary current components $I_A dx$, $I_A dy$, $I_A dz$ which, in turn, create elementary flux density components at the point of interest P. Using this law, and taking into account the geometry of the spiralling wire, we can write the following equations:

$$x=r\sin\theta \tag{12}$$

$$y=r\cos\theta \tag{13}$$

$$z=\theta\ L/2\pi \tag{14}$$

$$dx=r\cos\theta \tag{15}$$

$$dy=-r\sin\theta \tag{16}$$

$$dz=(L/2\pi)d\theta \tag{17}$$

$$m^2=x^2+(y_0-y)^2+(z_0-z)^2 \tag{18}$$

Each of the three elementary components $I_A dx$, $I_A dy$, $I_A dz$ gives rise to two of the following elementary flux density components dB(x), dB(y), dB(z), that respectively act along the X, Y, and Z axes. Their instantaneous values are are given by:

$$dB_A(y) \text{ due to } I_A dx=-I_A dx(z_0-z)/m^3 \tag{19}$$

$$dB_A(z) \text{ due to } I_A dx=+I_A dx(y_0-y)/m^3 \tag{20}$$

$$dB_A(x) \text{ due to } I_A dy=+I_A dy(z_0-z)/m^3 \tag{21}$$

$$dB_A(z) \text{ due to } I_A dy=+I_A dy\ x/m^3 \tag{22}$$

$$dB_A(x) \text{ due to } I_A dz=-I_A dz(y_0-y)/m^3 \tag{23}$$

$$dB_A(y) \text{ due to } I_A dz=-I_A dz\ x/m^3 \tag{24}$$

The total flux densities along the respective X, Y and Z axes are found by taking the sum of these elementary flux densities. However, we are interested in the flux densities created by all three spiraling wires. Consequently, the procedure described above must be repeated for phases B and C, taking into account that the respective wires are shifted in space by 120° and 240° with respect to the wire of phase A, and that they carry instantaneous currents $I_B$ and $I_C$ that are defined according to the schedule given in Table 1.

The total flux density acting along the X axis is then found by summing all the elementary flux densities along the X axis due to all three wires. This enables us to determine the RMS flux density along the X axis. The same procedure applies to the summation of the elementary flux densities respectively along the Y and Z axes. The totalized RMS flux density is then found by adding the X, Y and Z components of RMS flux density vectorially. This "totalized" RMS flux density $B_T$ corresponds to the reading that a 3-axis RMS flux density probe would give.

The equations described above cannot be solved analytically; therefore the summation process must be done numerically, by computer.

In the course of my investigation, I discovered that a graph could be plotted whereby the approximate value of the flux density $B_T$ could be predicted, knowing the cable parameters L and d, the current $I_L$, and the distance D from the longitudinal axis of the twisted cable.

TABLE 2

| d mm | L mm | D mm | $I_L$ A | $B_T$ mG | log D/L | $\log(B_T L^2/I_L d)$ — |
|---|---|---|---|---|---|---|
| 3.6 | 177 | 130 | 100 | 7.45 | −0.134 | 2.81 |
| 4.0 | 64 | 63 | 100 | 11.12 | −0.00684 | 2.056 |
| 3.0 | 200 | 50 | 100 | 237 | −0.602 | 4.50 |
| 21 | 760 | 105 | 100 | 447 | −0.860 | 5.09 |
| 3.5 | 14.58 | 17.5 | 100 | 54.7 | +0.0793 | 1.52 |
| 21 | 760 | 912 | 100 | 0.097 | +0.0792 | 1.42 |

To create this graph, I chose a broad range of generally unrelated values for L, d, $I_L$, and D, and for each set of values, calculated the resulting value of $B_T$, by computer. For illustrative purposes, Table 2 shows six typical sets of values that were used in creating the graph.

Figure 7A:
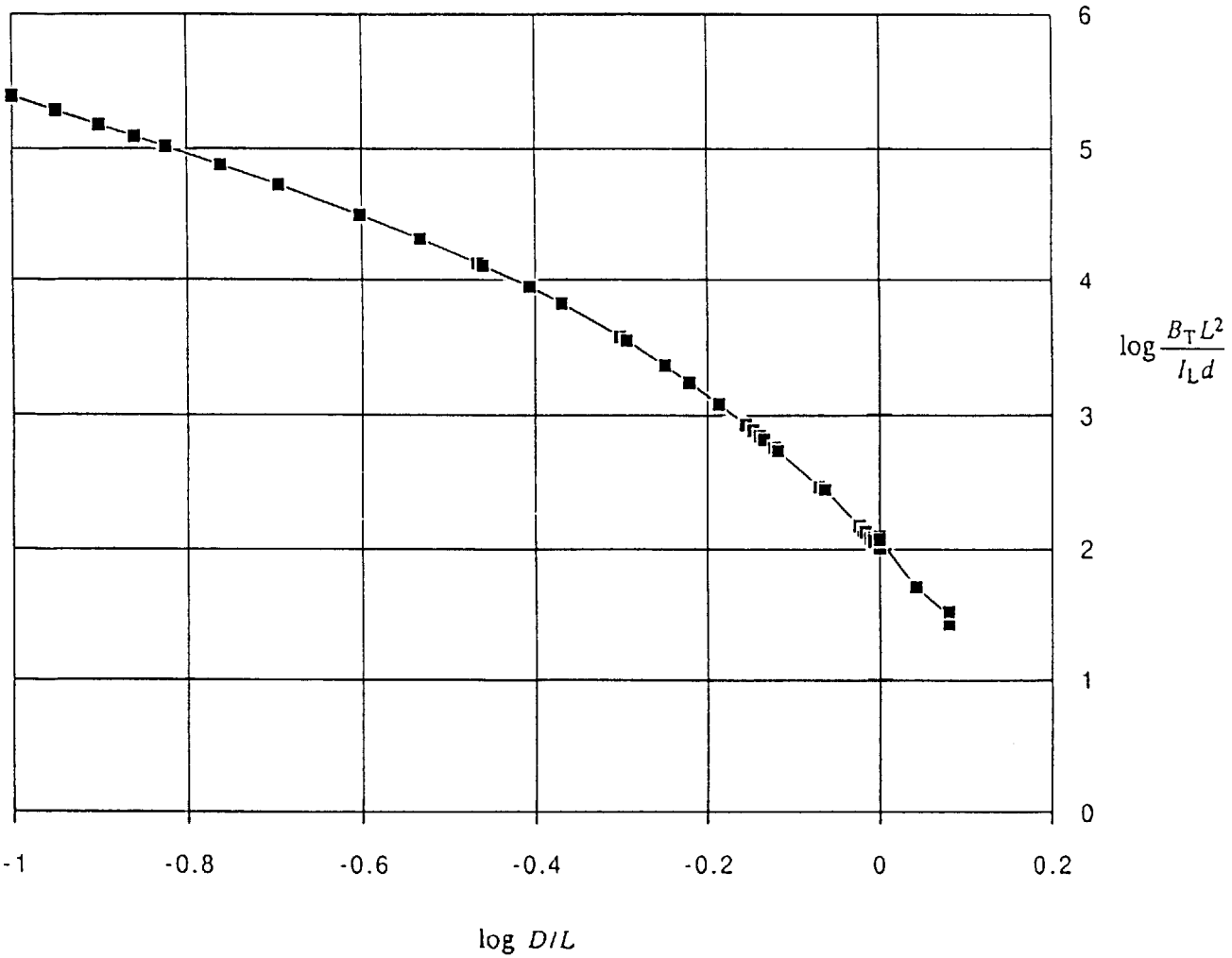
FIG. 7*a* is a scatter diagram and corresponding curve joining the points, representing the relationship between the computed values of flux density $B_T$ surrounding a twisted star cable, the distance D from the cable, and the parameters L, d, $I_L$ of the cable.
Figure 7B:
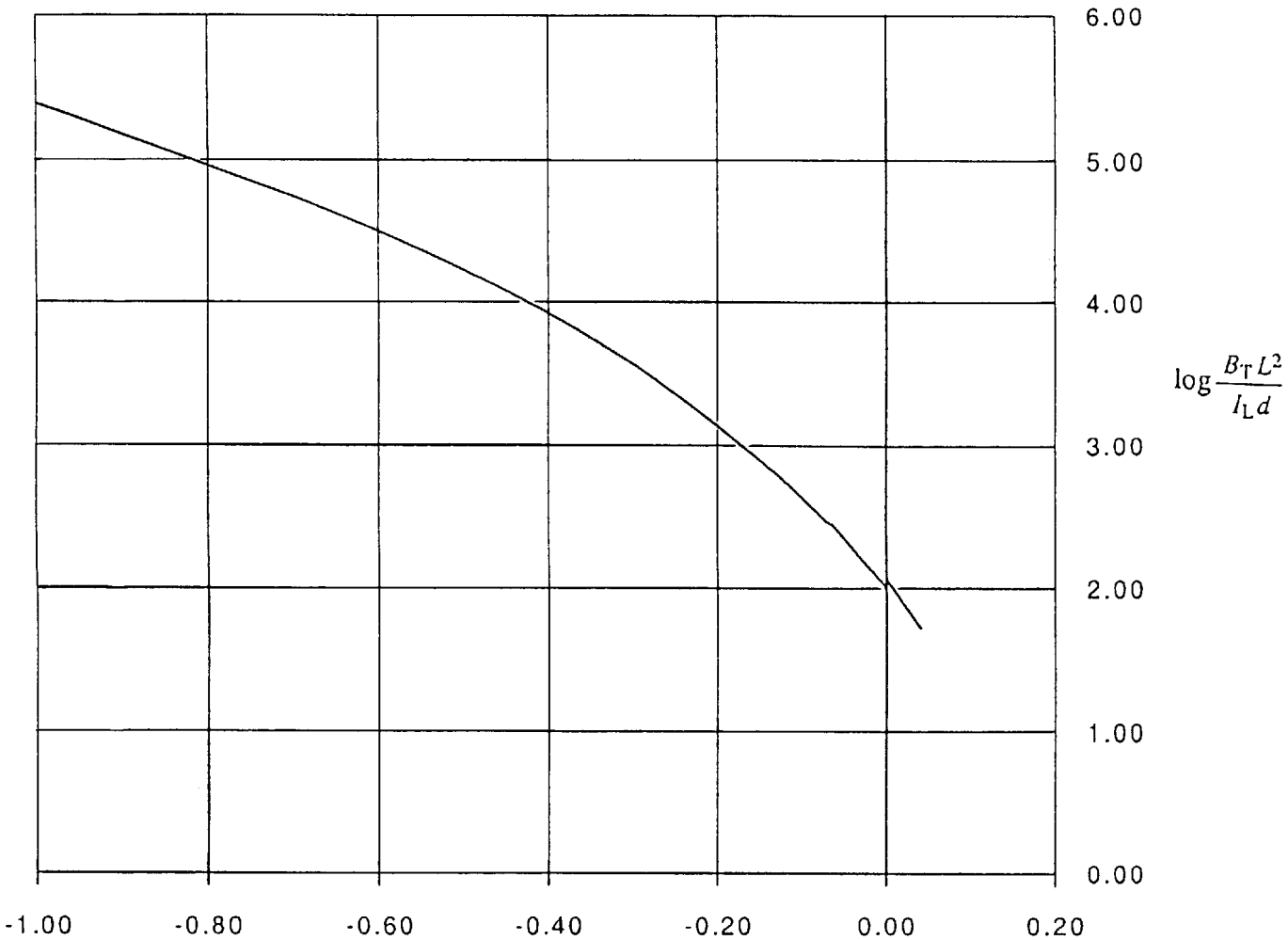
FIG. 7*b* is a curve identical to that in FIG. 7*a,* less the said points.

The flux density is strictly proportional to current $I_L$ and so a current of 100 A was used to determine the normalized relationship between log D/L and log ($B_T L^2/I_L$ d). The broad range of values illustrated in Table 2 is representative of the many points that were used to create the scatter diagram shown in FIG. 7*a*. FIG. 7*b* shows the curve without the point markers. The curve is valid for all values of L, d, $I_L$, D and B, provided that D>5 d and 0.1 L<D<1.2 L. Lengths are expressed in millimeters and $B_T$ is in milligauss.

In space-heating applications, the flux densities at distances D greater than 1.2 L are small (less than 1 mG) and are usually of no further interest. An example will illustrate the use of the graph in FIG. 7*b*.

EXAMPLE 1

A three-phase twisted star cable has the following parameters:

pitch L: 120 mm distance between wires d: 3.5 mm

RMS current per phase $I_L$: 27 A

It is required to calculate the flux density $B_T$ at a distance D of 30 mm from the center of the cable. We proceed as follows.

The graph can be used because 0.1 L<D<1.2 L and D>5 d. D/L=30/120=0.25; consequently, $\log_{10}D/L=\log_{10}0.25=-0.6$.

Referring to FIG. 7*b*, the corresponding value of $\log_{10} B_T L^2/Id$ is 4.5. Consequently, $B_T L^2/Id=10^{4.5}=31\,623$, and so $$B_T=31623\times Id/L^2=31\,623\times 27\times 3.5/120^2=207mG.$$

It is often useful to to estimate the value of the flux density at a given distance from a cable, without having to resort to complex calculations involving a computer. In other words, given the cable parameters, it is convenient to have an empirical equation that gives the approximate flux density $B_T$ as a function of the distance D. An empirical equation has the further advantage of highlighting the relative importance of the various parameters. These parameters are the distance d, the pitch L, and the RMS line current $I_L$, as previously defined.

Figure 7C:
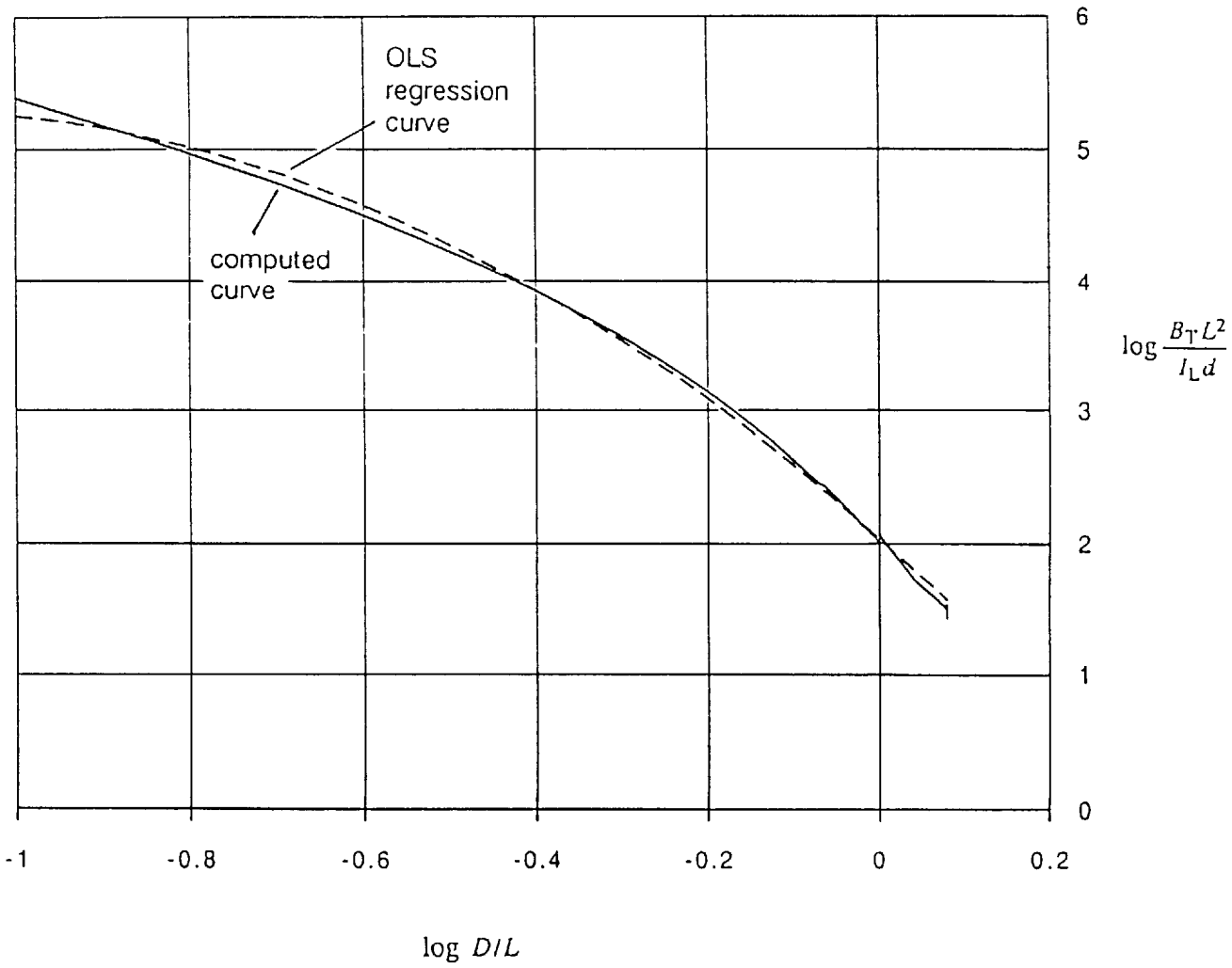
FIG. 7*c* shows a curve identical to that in FIG. 7*b,* plus a dotted curve representing an ordinary least square regression on the curve.

After analyzing the data used to create the graph of FIG. 7*b*, I found by ordinary least squares regression that the dotted curve shown in FIG. 7*c* is a good representation of the underlying computed curve, because the R-square determination coefficient is 0.9979. Using these results, the flux density can be expressed by the empirical equation:

$$B_T = 108\,\frac{I_L d}{L^2}\left(\frac{D}{L}\right)^{-5.755-2.541\,\log_{10}(D/L)} \tag{25}$$

in which $B_T$=total RMS flux density as measured by a three-axis probe [mG]

$I_L$ =RMS line current [A]

d=distance between the centers of the wires [mm]

L=pitch of cable [mm]

D=distance from the longitudinal axis at the geometric center of the cable, to the point of measurement of the flux density [mm] and wherein 0.1 L<D<1.2 L and D>5 d.

An example will illustrate the application of this formula.

EXAMPLE 2

A large cable carrying a current $I_L$ of 300 A, has the following parameters:

L=450 mm d=22 mm

It is required to determine the flux density at a distance of 315 mm (12.5") from the center of the cable. We calculate:

$$\begin{aligned} B_T &= 108\,\frac{I_L d}{L^2}\left(\frac{D}{L}\right)^{-5.755-2.541\,\log_{10}(D/L)} \qquad (25)\\ &= 108\times\frac{300\times 22}{450^2}\left(\frac{315}{450}\right)^{-5.755-2.541\,\log_{10}(315/450)}\\ &= 3.52\times 0.7^{-5.361} = 24\text{ mG}\end{aligned}$$

The graph of FIG. 7*b* also enables us to determine the rate of change of the flux density $B_T$ with distance D. In effect, for given values of L, d and $I_L$, the rate of change of $B_T$ with D depends upon the slope of the curve in FIG. 7*b*. In moving from left to right along the curve, the distance D is increasing, and the slope becomes progressively steeper. The approximate slopes are listed in Table 3 for representative D/L ratios. The Table reveals that for distances close to the cable, where D/L is of the order of 0.1, the approximate slope of the curve is −2. Thus, the flux density decreases inversely as the square of D, which corresponds to the rate of decrease of an ordinary straight star cable. However, when D/L=0.4, the slope is

TABLE 3

| D/L | log D/L | approx slope |
|---|---|---|
| 0.1 | −1.0 | −2 |
| 0.4 | −0.4 | −3 |
| 1.0 | 0 | −6 |

about −3 and so the flux density is decreasing inversely as the 3rd power of D. Then, when D/L=1, the flux is decreasing inversely as the 6th power of D, which means that $B_T$ decreases by 6 percent for every 1 percent increase in D.

The very high rate of decrease of the flux density with distance of a twisted star cable makes this type of cable particularly attractive for space-heating applications.

EXPERIMENTAL AND CALCULATED RESULTS

In order to confirm my findings, the magnetic field $B_T$ was measured around a twisted star cable having the following parameters:

wire type: 3-conductor, No 14 AWG distance between wires: d=3.5 mm radius r=3.5/√3=2.02 mm pitch of wires: L=114 mm (4.5")

The cable was connected to a 3-phase source and the RMS current per phase was set at $I_L$=20.6 A. The distances from the longitudinal axis of the twisted cable ranged from 23 mm to 98 mm. Each reading of $B_T$ represents the average of 9 readings, spaced at 50 mm intervals along the length of the cable. The ambient flux density was 0.3 mG.

The experimental values of the flux densities at these various distances D are listed in column 2 of Table 4. The experimental values were obtained using a three-axis probe. The values of $B_T$ obtained by computer are shown in column 3.

The agreement between the experimental and mathematical results was found to be statistically significant.

In space-heating systems, the distance between adjacent cable runs is typically between 75 mm and 300 mm. Consequently, if the pitch L is, say, 150 mm or less, the effect of the magnetic field created by one run upon that of a neighboring run is relatively small. Thus, by a proper selection of the cable pitch, we need to consider only one cable in the evaluation of the maximum magnetic flux density above a heated surface.

TABLE 4

| D distance mm | $B_T$ by experiment mG | $B_T$ by computer mG |
|---|---|---|
| 23 | 311 | 295 |
| 28 | 190 | 183 |
| 33 | 123 | 119 |
| 38 | 81.2 | 80.2 |
| 43 | 55.3 | 54.9 |
| 48 | 38.3 | 38.2 |
| 53 | 27.1 | 26.9 |
| 58 | 19.1 | 19.1 |
| 63 | 13.5 | 13.7 |
| 68 | 9.5 | 9.8 |
| 73 | 6.8 | 7.1 |
| 78 | 5.0 | 5.2 |
| 83 | 3.6 | 3.76 |
| 88 | 2.6 | 2.75 |

TABLE 4-continued

| D distance mm | $B_T$ by experiment mG | $B_T$ by computer mG |
|---|---|---|
| 93 | 1.9 | 2.02 |
| 98 | 1.4 | 1.49 |

DESCRIPTION OF A HEATING SYSTEM

Figure 8:
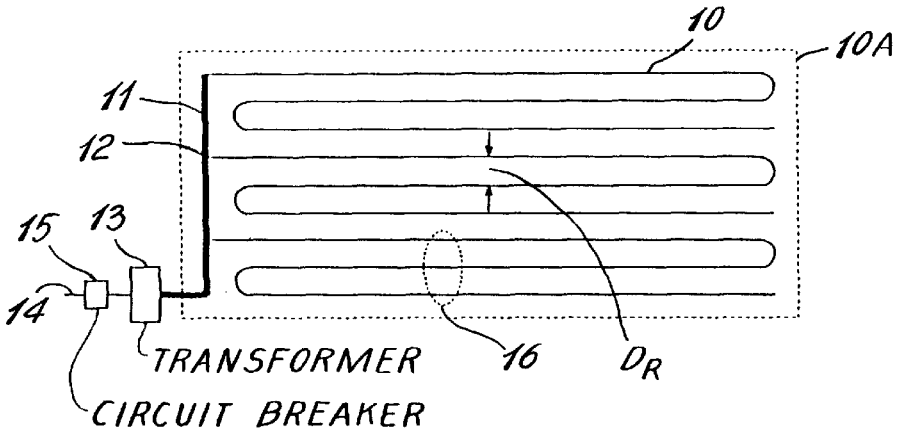
FIG. 8 is a schematic diagram showing the essential elements of the electrical heating system covered by the present invention.

FIG. 8 shows the basic elements of an electrical heating system covered by this invention. A surface area 10A is heated by means of a plurality of twisted star cables 10 that are connected to a three-phase feeder 11 by means of connections 12. The feeder is powered by a three-phase transformer 13 that is connected on its primary side to a 3-phase supply line 14 by means of circuit-breaker 15. By way of example, each cable is assumed to make three contiguous runs, labeled 16. The secondary line-to-line voltage is 600 V or less, to keep the system in the low-voltage or extra-low-voltage class.

As previously described, each heating cable 10 consists of three insulated wires whose centers are equidistant from each other, all enclosed in a common sheath. The wires are in close proximity to each other and are uniformly and smoothly twisted with a pitch L. The length of a pitch may typically range from 50 mm (2") to 200 mm (8"). The cables develop a thermal power of $P_C$ watts per unit length. The value of $P_C$ depends upon several factors, such as the feeder voltage, the wire size, the length of cable and the resistivity of the wire material. For a given voltage, wire size and wire material, the cable lengths are set so that the resulting value of $P_C$ maintains the temperature of the wires at or below the rated temperature of the cable. The rated temperature is typically less than 90° C.

The cable runs are spaced at such a distance $D_R$ from each other so as to develop the desired thermal power density $P_D$ required by the heated surface area. The value of $D_R$ is given by:

$$D_R=P_C/P_D \tag{26}$$

in which $D_R$=distance between cable runs [m]

$P_C$=thermal power per unit length [W/m]

$P_D$=thermal power density [W/m$^2$]

Figure 9:
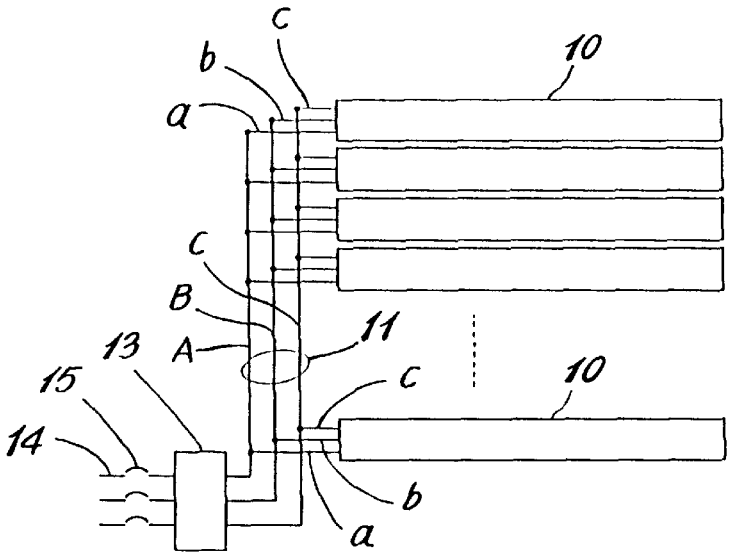
FIG. 9 is a schematic diagram showing in greater detail the cables and feeder of a 3-phase electrical heating system.

FIG. 9 shows in greater detail the method of connecting the twisted star cables to a conventional 3-phase feeder having three busbars A, B, C. In a typical extra-low-voltage installation, where the supply voltage is 30 V or less, each transformer has a capacity of 10 kVA, capable of furnishing a 3-phase current of about 200 A to the feeder. In larger installations, several transformers may be used, each connected to the main supply line 14 and furnishing power to its particular heating zone.

CABLE PARAMETERS AND CHARACTERISTICS

In addition to low flux densities, the heating cables must meet the requirements listed in the objectives of this invention. Thus, they must be robust, operate at temperatures below 90° C., and be as long as possible in order to reduce the number of cables that have to be connected to a feeder. Another objective is that the cables should be standardized as to wire size, wire material, and wire configuration so that a particular type of cable may be used in different heating installations. In order to meet these objectives and to evaluate the interaction of the various requirements, we postulate the parameters listed in Table 5.

TABLE 5

| Parameter | symbol | unit |
|---|---|---|
| Line-to-line operating voltage of heating system: | E | volt [V] |
| Thermal power density of heating system: | $P_D$ | watt per square meter [W/m$^2$] |
| Thermal power per unit length of cable: | $P_C$ | watt per meter [W/m] |
| Length of cable: | $L_A$ | meter [m] |
| Pitch of cable: | L | millimeter [mm] |
| Distance between wires in cable | d | millimeter [mm] |
| Total cross section of all wires in the cable | A | square meter [m$^2$] |
| Resistivity of wire material: | ρ | ohm-meter [Ω · m] |

Using these parameters, the features of the cable can be analyzed and evaluated. In making the evaluation, we assume that the line-to-line operating voltage E, the thermal power per unit length $P_C$, and the total cross section A of the current-carrying wires are given. Let us examine a 3-phase twisted star cable, illustrated schematically in FIG. 2*a*. We reason as follows:

Power source: 3-phase Physical length of cable=$L_A$

Wires per cable: 3

Electrical length of cable, per phase: $L_E=L_A\ (1+2\pi d/(L\sqrt{3}))=kL_A$ where k=factor taking into account the d/L ratio of the twisted cable.

Cross section of one wire=A/3

$$\text{resistance of wire for one phase: } R=\frac{\rho L_E}{A/3}=\frac{3\rho k L_A}{A} \tag{27}$$

$$\text{total heating power of cable}=\frac{E^2}{R}=\frac{E^2 A}{3\rho k L_A} \tag{28}$$

$$\text{thermal power per unit length } P_C=\frac{E^2 A}{3\rho k L_A{}^2} \tag{29}$$

$$\text{length of cable } L_A=\frac{E}{\sqrt{3}}\sqrt{\frac{A}{\rho k P_C}}=0.577\,E\sqrt{\frac{A}{\rho k P_C}} \tag{30}$$

$$\text{RMS* line current } I_L=\frac{P_C L_A}{E\sqrt{3}}=\frac{1}{3}\sqrt{\frac{A P_C}{\rho k}} \tag{31}$$

*RMS = root mean square

CHOICE OF WIRE MATERIAL AND INDIVIDUAL CABLE LENGTH

Equation (30), reveals that the length of individual cables depends mainly on E, A, $P_C$ and ρ, multiplied by the coefficient 0.577. To ensure robustness, the total cross section A of the three wires should not be too small. Typical values for surface heating range from 5 mm$^2$ to 10 mm$^2$. However, for special applications, smaller or larger values can be employed. In an extra-low-voltage electrical heating system, the voltage E is low, being 30 V or less. Consequently, according to Eq. (30), which indicates that the cable length is proportional to E, the cable lengths tend to be short, which is a disadvantage. To resolve this problem, the question now arises as to what values of $P_C$ and ρ should be used.

In any given surface-heating project requiring a total power P, the total length of all the heating cables is equal to $P/P_C$. In order to minimize the cost, this total length should be as small as possible, which means that $P_C$ should be as large as possible. However, the value of $P_C$ is limited to the maximum $P_{Cmax}$ that the cable can withstand. That depends upon the maximum allowable temperature of the cable as well as the environmental conditions, such as the ambient temperature and the emplacement of the cables.

For a given cable having a total wire cross section A there is a corresponding $P_{Cmax}$, as defined above, no matter what conductive material is used for the wires. Thus, given the total cross section A and knowing the value of $P_{Cmax}$ and recognizing that in the case of an extra-low-voltage system, E has an upper limit of 30 V, it follows from Eq. (30), that to obtain the longest possible individual cable, the resistivity ρ of the material should be as low as possible. Copper has the lowest resistivity of all practical conducting materials and so it is a logical choice. However, aluminum is also a satisfactory choice.

If the electrical heating system is a low-voltage system, hence designed for voltages above 30 V and less than 600 V, the same twisted type of heating cables can be used, except they must be longer.

Some insulated cables may include a metallic braided sheath that surrounds the three wires, for electrical grounding purposes. Other insulated cables may have a flexible armoured sheath, to provide additional mechanical protection around the three wires. These metallic braids or armoured sheaths are usually made of non-ferrous materials and will not significantly affect the magnitude of the flux densities surrounding the respective cables when the heating wires carry currents. If anything, the metallic sheaths will tend to reduce the flux densities below the calculated values, due to the opposing currents that are induced therein. Still other insulated cables may have three heating wires plus one or more additional wires for monitoring or for grounding purposes. Under normal operating conditions, such additional wires will not affect the flux densities surrounding the cables.

These findings regarding the appropriate wire material and cable lengths constitute a further attribute of this invention.

EXAMPLE 3

It is required to calculate the length of a 3-phase star cable composed of three copper wires, No. 14 AWG, knowing that the temperature is limited to a maximum of 60° C. The line voltage is 30 V and the desired thermal power $P_C$ is 25 W/m. The resistivity of copper at 60° C. is 20 nΩ.m and the cross section of the individual wires is 2.08 mm$^2$. The pitch is 105 mm and the distance between wires is d=3.6 mm.

The length is found by Eq. (30). The value of $k=(1+2\pi\times 3.6/(105\sqrt{3}))=1.124$.

$$\text{Length} = 0.577\,E\sqrt{\frac{A}{\rho k P_C}} \tag{30}$$

$$= 0.577 \times 30\sqrt{\frac{3 \times 2.08 \times 10^{-6}}{20 \times 10^{-9} \times 1.124 \times 25}}$$

$$= 57.67\ \text{m}(= 189\ \text{ft})$$

MAGNETIC FIELD PRODUCED BY THE FEEDER

Figure 10:
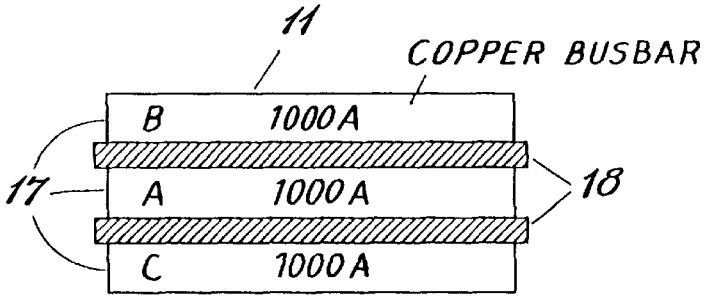
FIG. 10 (PRIOR ART)
FIG. 10 is a cross section view of a 3-phase feeder of the prior art.

FIG. 9 shows a heating system wherein a conventional 3-phase feeder 11, composed of three copper busbars, delivers power to a plurality of individual cables 10 distributed along its length. As the current builds up along the length of the feeder, the busbars A, B, C may eventually carry currents of several hundred amperes. This creates a problem as far as the magnetic field surrounding the feeder is concerned. The feeder 11 is usually composed of three busbars, traditionally stacked as shown in FIG. 10, which is a cross section view. Two thin strips of insulation 18 separate the respective busbars 17.

In this Figure, for purposes of illustration, suppose each copper bar is 24 mm (1 in) wide and 6 mm (0.25 in) thick, separated by an insulating strip of 1.5 mm. Such a feeder can carry an RMS current of about 250 A, per phase. When the RMS 3-phase current delivered by the transformer is 250 A, the feeder produces the approximate RMS flux densities shown in Table 6, wherein the values were obtained by computer simulation.

Distances are measured from the longitudinal axis at the geometric center of the feeder and the flux densities correspond to those that would be obtained with a 3-axis probe.

TABLE 6

Three busbar configuration (250 A/phase)

| distance from feeder | | RMS flux density |
|---|---|---|
| mm | inches | milligauss |
| 100 | 4 | 1900 |
| 250 | 10 | 300 |
| 500 | 20 | 74 |
| 1000 | 40 | 18 |

These flux densities are too high if television screens and other sensitive devices are located closer than about 24 inches from the transformer end of the feeder. For this reason, a three-phase feeder, similar in construction to a twisted star cable (except that the far end is not short circuited), is desirable for this extra-low-voltage heating system. The twisted feeder can be represented by feeder 11 in FIG. 9. The three spiraling conductors of the feeder are tapped off along their length to feed power to the individual heating cables.

In a manner similar to that used in determining the flux density formula of a heating cable, we use the same empirical formula for a twisted feeder, as illustrated by the following example.

EXAMPLE 4

Assume cross section per conductor=that of the flat busbar=144 mm$^2$. Round conductors are used. We assume the following parameters for the feeder:

L=450 mm d=20 mm $I_L$=250 A

Using Eq. (25), we draw up Table 7, showing the flux density $B_T$ at various distances D. It is seen that $B_T$ decreases very rapidly with distance, and that the 50 mG level is now reached at some 10 inches from the cable.

TABLE 7

Twisted feeder configuration (250 A/phase)

| distance from feeder | | RMS flux density |
|---|---|---|
| mm | inches | milligauss |
| 100 | 4 | 1264 |
| 250 | 10 | 54 |
| 500 | 20 | 1.4 |

LOW-VOLTAGE SYSTEM

The features of the electrical heating cable and system disclosed herein can readily be adapted to a low-voltage system wherein the line voltage exceeds 30 V but is less than 600 V. Thus, three-phase line voltages such as 120 V and 208 V can be used in conjunction with twisted heating cables and twisted feeders. The only requirement is that ground fault circuit interrupter (GFCI) means must be added to the system to provide protection against electric shock. The mode of application of these GFCI devices and other safety specifications are well known in the art and form part of the requirements of the electrical code.

In such low-voltage systems, the same equations and empirical formulas disclosed herein can be used to determine the length of the heating cables and the magnetic flux densities they produce.

It is within the ambit of the present invention to cover any obvious modifications of the examples of the preferred embodiment described herein, provided such modifications fall within the scope of the appended claims.

I claim:

1. An electrical heating system for heating a surface area, said system comprising at least one cable having three conductive heating wires contained in an insulated sheath, said wires being permanently fixed, in a specific physical configuration from one another in said insulated sheath, said three heating wires being connected together at a far end of said cable, a three-phase voltage supply source connected to a near end of said three wires of said cable, said wires having a low resistivity similar to that of copper or aluminum, said cable having a length ($L_A$) based on specific parameters of said heating system including (i) the operating voltage (E) of said supply source, (ii) the total cross sectional dimension (A) of said three heating wires, (iii) the resistivity (ρ) of the wire material, (iv) the desired thermal power per unit length ($P_C$) of said cable, a distance (d) as measured between a center of said wires, and (vi) a pitch (L) of said cable, said three heating wires of said cable being symmetrically arranged in a triangular configuration such that said wires are located at a distance (r) from a longitudinal axis of said cable as measured from a center of said wires, said cable being twisted with a pitch (L) as measured along said longitudinal axis of said cable, said cable producing a resultant magnetic flux density ($B_T$) of a substantially specific value calculated at a predetermined distance (D) from said cable when current flows in said heating wires in said cable, and calculated in accordance with the following formula $$B_T = 108 \frac{I_L d}{L^2} \left(\frac{D}{L}\right)^{-5.755-2.541\ log_{10}(D/L)}$$

said formula constituting the result of an ordinary least squares regression of points derived from calculated values of $\log_{10}(B_T L^2/I_L d)$ versus $\log_{10}(D/L)$, and within the limits D>5 d and 0.1 L<D<1.2 L, and wherein the symbols carry the following units: d, D, and L in millimeters, $I_L$ in amperes RMS, and $B_T$ in milligauss RMS, L is the pitch of said cable, d is the distance between said centers of said wires, $I_L$ is an RMS line current carried by said three wires, and wherein the said distance D is a perpendicular distance from said longitudinal axis of said cable.

2. An electrical heating system as claimed in claim 1 wherein said three-phase voltage supply source is an extra-low-voltage supply source of 30 volts or less.

3. An electrical heating system as claimed in claim 2 wherein there is further provided a feeder conductor means connected to said voltage supply source, said near end of said three conductive heating wires being connected to said feeder conductor means.

4. An electrical heating system in accordance with claim 3, wherein each one of said three wires is separated from an other one of said three wires by a distance d, as measured from a center of said wires, said distance d being equal to √3 times said distance r.

5. An electrical heating system in accordance with claim 4, wherein a conductive extension of each of said three wires at a near end of said cable constitute connecting leads of a star cable.

6. An electrical heating system in accordance with claim 5, wherein said surface area is a surface forming material having a surface to be heated by said cables.

7. An electrical heating system in accordance with claim 6, wherein there is a plurality of said cables retained in cable runs disposed in parallel relationship to one another in a common plane and at a predetermined distance $D_R$ between each other.

8. An electrical heating system in accordance with claim 7, wherein said distance $D_R$ between adjacent cable runs of said plurality of cables is given by the formula $$D_R = P_C / P_D$$

wherein $D_R$ is expressed in meters, $P_D$ is the desired heating power density expressed in watts per square meter, and $P_C$ is said desired thermal power per unit length of said cable, expressed in watts per meter.

9. An electrical heating system in accordance with claim 8, wherein said voltage supply source has a three-phase step-down transformer provided with three secondary terminals between which exists a line-to-line voltage which is said supply source of 30 volts or less, said secondary terminals being connected to three busbars constituting said feeder conductor means.

10. An electrical heating system in accordance with claim 9, wherein said connecting leads of said plurality of said star cables are respectively connected to one of said three busbars, said longitudinal axis of each said cables being substantially coplanar, wherein to heat said surface area.

11. An electrical heating system in accordance with claim 10, wherein each said star cable comprises one or more cable runs.

12. An electrical heating system in accordance with claim 2, wherein said resultant magnetic flux density $B_T$ is measured at a point approximately in a middle of said cable at a distance D perpendicular to said longitudinal axis of said cable, and wherein said distance D is greater than 5 times said distance d and greater than 0.1 times said pitch L and less than 1.2 times said pitch L.

13. An electrical heating system in accordance with claim 9 wherein said three busbars consist of a three-conductor cable that is twisted along its longitudinal axis, whereby to reduce the flux density in a vicinity of said feeder when said feeder carries an electric current.

14. An electrical heating system in accordance with claim 6, wherein said surface area is a flat surface area.

15. An electrical heating system in accordance with claim 6, wherein said surface area is a non-flat surface area.

16. An electrical heating system as claimed in claim 1, wherein said cables have a substantially round cross-section.

17. An electrical heating system in accordance with claim 1, wherein said three-phase voltage supply source is a low-voltage supply source having a voltage greater than 30 V and less than 600 V.

18. An electrical heating system as claimed in claim 17 wherein there is further provided a feeder conductor means connected to said voltage supply source, said near end of said three conductive heating wires being connected to said feeder conductor means.

19. An electrical heating system in accordance with claim 18, wherein each one of said three wires is separated from an other one of said three wires by a distance d, as measured from a center of said wires, said distance d being equal to √3 times said distance r.

20. An electrical heating system in accordance with claim 19, wherein a conductive extension of each of said three wires at a near end of said cable constitute connecting leads of a star cable.

21. An electrical heating system in accordance with claim 20, wherein said surface area is a surface forming material having a surface to be heated by said cables.

22. An electrical heating system in accordance with claim 21, wherein there is a plurality of said cables retained in cable runs disposed in parallel relationship to one another in a common plane and at a predetermined distance $D_R$ between each other.

23. An electrical heating system in accordance with claim 22, wherein said distance $D_R$ between adjacent cable runs of said plurality of cables is given by the formula $$D_R = P_C / P_D$$

wherein $D_R$ is expressed in meters, $P_D$ is the desired heating power density expressed in watts per square meter, and $P_C$ is said desired thermal power per unit length of said cable, expressed in watts per meter.

24. An electrical heating system in accordance with claim 23, wherein said voltage supply source is a low-voltage source having three terminals between which exists a line-to-line voltage which is said supply source of more than 30 volts and less than 600 volts, said terminals being connected to three busbars constituting said feeder conductor means.

25. An electrical heating system in accordance with claim 24, wherein said connecting leads of said plurality of said star cables are respectively connected to one of said three busbars, said longitudinal axis of each said cables being substantially coplanar, wherein to heat said surface area.

26. An electrical heating system in accordance with claim 25, wherein each said star cable comprises one or more cable runs.

27. An electrical heating system in accordance with claim 17, wherein said resultant magnetic flux density $B_T$ is measured at a point approximately in a middle of said cable at a distance D perpendicular to said longitudinal axis of said cable, and wherein said distance D is greater than 5 times said distance d and greater than 0.1 times said pitch L and less than 1.2 times said pitch L.

28. An electrical heating system in accordance with claim 24 wherein said three busbars consist of a three-conductor cable that is twisted along its longitudinal axis, whereby to reduce the flux density in a vicinity of said feeder when said feeder carries an electric current.

29. An electrical heating system in accordance with claim 21, wherein said surface area is a flat surface area.

30. An electrical heating system in accordance with claim 21, wherein said surface area is a non-flat surface area.

* * * * *

UNITED STATES PATENT AND TRADEMARK OFFICE

CERTIFICATE OF CORRECTION

PATENT NO. : 5,811,767

DATED : September 22, 1998

INVENTOR(S) : THEODORE WILDI

It is certified that error appears in the above-identified patent and that said Letters Patent is hereby corrected as shown below:

Column 3, in Table 1, lines 21 and 25, change "0.5 $I_m$" to --- $-0.5I_m$ ---.

Column 7, line 26, change "they" to --- the ---.

Column 12, line 35, change "andD>5" to --- and D>5 ---.

Signed and Sealed this

Eleventh Day of May, 1999

*Attest:*

*Attesting Officer*

Q. TODD DICKINSON

*Acting Commissioner of Patents and Trademarks*